United States Patent [19]

Inzana et al.

[11] 4,033,364

[45] July 5, 1977

[54] EYE MAKE-UP SHIELD

[76] Inventors: Margaret Inzana, 274 Logan Ave., Bronx, N.Y. 10465; Joann Terrett, 3260 Cruger Ave., Bronx, N.Y. 10467

[22] Filed: Aug. 13, 1975

[21] Appl. No.: 599,513

[52] U.S. Cl. ..... 132/88.5

[51] Int. Cl.[2] ..... A45D 40/30

[58] Field of Search ..... 132/88.5, 88.7, 53, 132/31.2, 32.3, 1

[56] References Cited

UNITED STATES PATENTS

| | | | |
|---|---|---|---|
| 2,268,082 | 12/1941 | **Phillips, Sr.** | 132/53 |
| 3,343,552 | 9/1967 | **Steffen** | 132/88.7 |
| 3,511,248 | 5/1970 | **Panda** | 132/1 |

*Primary Examiner*—G.E. McNeill

[57] ABSTRACT

Disclosed is a shield for use in applying mascara to the eyelashes which prevents the smudging of previously applied eye shadow and/or eye liner. The shield comprises an elongate handle portion (which may optionally include a mascara container) and an eyelid covering portion having a shape and curvature generally conforming to the shape and curvature of an upper human eyelid and which when placed over an upper human eyelid will cover same and thereby shield any eye shadow previously applied thereto while leaving the upper eyelashes exposed for the application of mascara without any risk of smudging the thusly shielded eye shadow with said mascara.

6 Claims, 5 Drawing Figures

EYE MAKE-UP SHIELD

BACKGROUND OF THE INVENTION

The invention relates to cosmetics and more particularly, to devices which enable a person to apply eye make-up such as mascara without disturbing or smudging previously applied eye make-up such as eye shadow and/or eye liner when applying the mascara.

SUMMARY OF THE INVENTION

Ordinarily when a woman applies eye make-up, a certain sequence of operations is followed. Thus, when it is desired to completely make up one's eyes with the three most commonly used types of eye make-up, i.e., eye shadow, eye liner and mascara, the woman usually applies the eye shadow first followed by the eye liner (although either one or both may be omitted) and finally the mascara. It is well known that when mascara is applied to the eyelashes, subsequent to the application of eye shadow and/or eye liner, particularly eye shadow, there is a great risk of smudging the eye shadow, which is generally of a light color, with the subsequently applied mascara which is generally of a much darker color. Of course, when this happens if is usually necessary for the woman, who more often than not, is in a hurry, to completely remove the previously applied eye shadow and the mascara and start all over again.

Because of this problem, women have long sought a simple and inexpensive expedient which can be used to assist them in applying mascara while avoiding the smudging of previously applied eye shadow with the mascara, or when no eye shadow is used, of avoiding the smudging of the skin with the mascara.

It is an object of the present invention to solve these long standing problems and meet the long felt need for inexpensive and easy to use devices which will enable a woman to apply mascara without fear of smudging either her skin or previously applied eye make-up.

Figure 3:
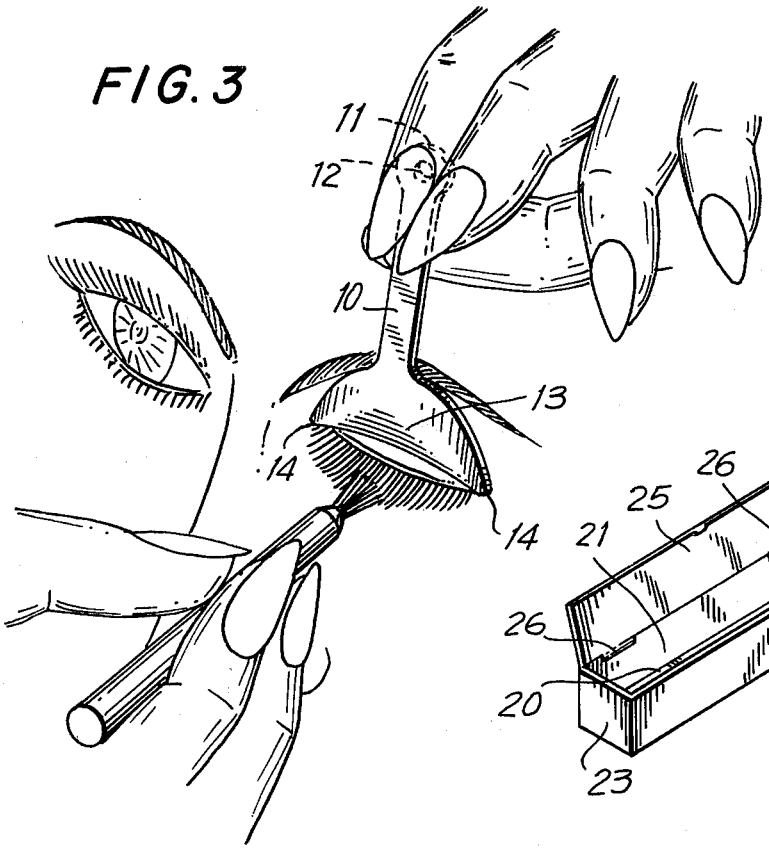
FIG. 3 is a perspective view showing the device of FIG. 1 in use during the application of mascara to an eye.

Accordingly, the invention provides, in one embodiment thereof, an eye make-up shield comprising an elongate handle portion and an eyelid covering portion which is attached to one end of the handle portion; preferably, the two aforementioned portions are unitary in structure, being pressed, stamped, cut or molded from a single piece of the material of which the device is made. This material may be, for example, paper, preferably a hard, stiff paper such as cardboard, or an inexpensive plastic. The eyelid covering portion has a shape and curvature which generally conforms to the shape and curvature of an upper human eyelid so that when the eyelid covering portion is held in place over an upper human eyelid as shown in FIG. 3, the eyelid is completely protected while the eyelashes are exposed for the application thereto of mascara.

In an alternative embodiment, the elongate handle portion comprises a generally hollow container which will preferably be filled with mascara, the entire device therefore constituting a mascara supply and eye make-up shield.

DETAILED DESCRIPTION OF THE PREFERRED EMBODIMENTS

The invention will now be described in greater detail in conjunction with the drawings, wherein like parts bear the same reference numerals in the several figures.

Figure 1:
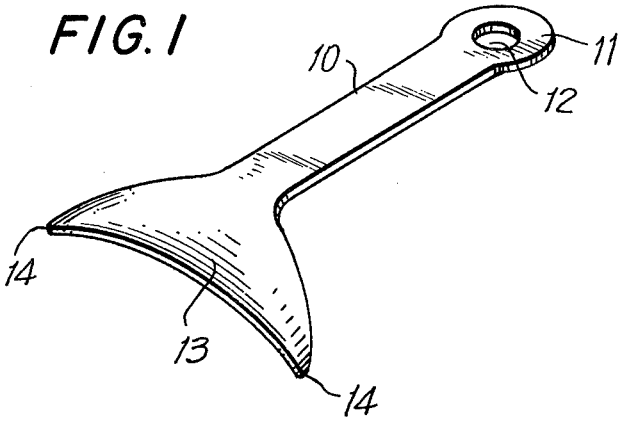
FIG. 1 is a plan view of one embodiment of the eye make-up shield of the invention.
Figure 2:
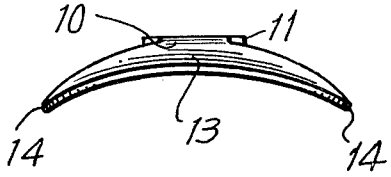
FIG. 2 is an end view of the eye make-up shield of FIG. 1, showing the curvature of the eyelid covering portion thereof which generally conforms to the shape and curvature of an upper human eyelid.

Referring to FIG. 1, the eye make-up shield of the invention is shown in plan view. An elongate handle portion 10 of generally rectangular shape terminates in an end zone 11 which may be optionally rounded off and which may also optionally be provided with a hole 12 to permit convenient hanging of the device on a hook or the like. Attached to, and preferably contiguous with the end of the handle portion distal the end zone 11 is eyelid covering portion 13 having a generally crescent-like shape, the points 14 of the crescent being slightly rounded so as to avoid damage to the corners of the eye when the device is used. The shape and curvature of the crescent-like eyelid covering portion is such that it generally conforms to the shape and curvature of an upper human eyelid as shown in FIGS. 1 and 2.

In FIG. 3, the device is shown while being used by a woman in the act of applying mascara to her eye.

Figure 4:
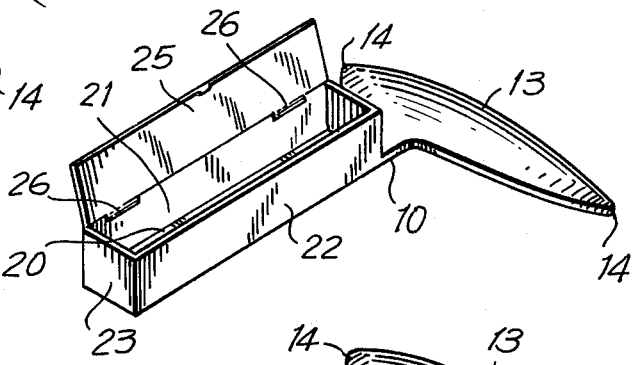
FIG. 4 is a plan view of an alternative embodiment of the eye make-up shield of FIG. 1.

FIG. 4 shows an alternative embodiment of the invention wherein the elongate handle portion also includes a mascara container. Thus, elongate handle portion 10 includes a base 20, a pair of side walls 21 and 22 and an end wall 23 defining a generally rectangular container which may be filled with mascara. The thus defined container is provided with a cover 25 to protect the mascara. Cover 25 may be conveniently secured to the container by means of a hinge, 26 or a snap or other suitable connecting means such a slide track.

Figure 5:
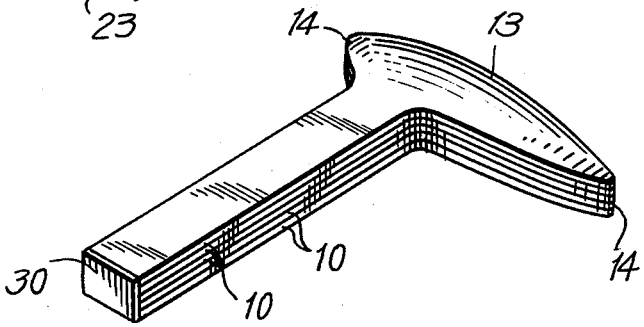
FIG. 5 is a plan view of a package of the eye make-up shields of FIG. 1.

In FIG. 5, there is seen a stack of the eye make-up shields of FIG. 1 in the form of a pad, the end zones of each such shield being joined by, e.g., a gum strip 30 of the type generally used in paper pads. This arrangement may be used to merchandise the eye make-up shields as a package from which the user may remove shields one at a time for use.

Variations and modifications can, of course, be made without departing from the spirit and scope of the invention.

Having thus described our invention, what we desire to secure by Letters Patent and hereby claim is:

1. An eye make-up shield for use in applying mascara to the eyelashes, said shield comprising a handle portion and connected thereto, an eyelid covering portion, said eyelid covering portion simultaneously having a crescent-like shape generally conforming to the shape of a human eyelid and a curvature generally conforming to the curvature of a human eyelid, whereby to enable a user to substantially completely shield her eyelid while leaving her eyelashes exposed when positioning the shield on said eyelid with one hand and to apply mascara to said exposed eyelashes with a separate mascara applicator with the other hand.

2. An eye make-up shield according to claim 1, wherein the handle portion is elongate.

3. An eye make-up shield according to claim 2, wherein the end of the elongate handle portion distal the eyelid covering portion is rounded off and is provided with a hole.

4. An eye make-up shield according to claim 2, wherein the elongate handle portion includes a container for mascara.

5. An eye make-up shield according to claim 1 and made of paper or plastic.

6. A plurality of eye make-up shields as claimed in claim 1, in the form of a pad wherein an end of the handle portion of each of said shields is connected to a gum strip for enabling the removal of one shield at a time from the pad for use.

* * * * *